US005320251A

United States Patent [19]

Ellis

[11] Patent Number: 5,320,251

[45] Date of Patent: Jun. 14, 1994

[54] MATERIALS HANDLING EQUIPMENT

[75] Inventor: Peter J. Ellis, Salford, England

[73] Assignee: Flomat Limited, Glossop, England

[21] Appl. No.: 36,491

[22] Filed: Mar. 24, 1993

[30] Foreign Application Priority Data

Mar. 25, 1992 [GB] United Kingdom ..... 9206521

[51] Int. Cl.[5] ..... B65D 35/56

[52] U.S. Cl. ..... 222/105; 222/185; 242/67.1 R

[58] Field of Search ..... 242/67.1 R; 222/99-101, 105, 181, 185, 95, 386.5; 414/403, 411

[56] References Cited

U.S. PATENT DOCUMENTS

| | | | |
|---|---|---|---|
| 2,722,171 | 11/1955 | Deringer | 222/386.5 X |
| 3,095,206 | 6/1963 | Fresia et al. | 222/99 X |
| 3,430,815 | 3/1969 | Weimer et al. | 222/99 |
| 4,161,263 | 7/1979 | Wagner | 222/100 |
| 4,327,844 | 5/1982 | Gratschew | 222/100 |
| 4,883,201 | 11/1989 | Poulton | 222/181 X |
| 4,998,991 | 3/1991 | Poulton | 222/181 |

*Primary Examiner*—Kevin P. Shaver
*Attorney, Agent, or Firm*—Charles E. Baxley

[57] ABSTRACT

An apparatus for handling bulk materials includes a rigging frame which supports the upper end of the outer bag of an intermediate bulk carrier. A spool is rotatably mounted on the rigging frame and the inner bag of the intermediate bulk carrier is attached to the spool. The spool is rotated by a pneumatic cylinder thereby winding the inner bag onto the spool and emptying the inner bag.

6 Claims, 4 Drawing Sheets

MATERIALS HANDLING EQUIPMENT

BACKGROUND OF THE INVENTION

This invention concerns equipment for handling powdered, granulated or other particulate solid materials and more especially equipment of the kind (hereinafter termed "of the kind referred to") used to assist the discharge of such materials from intermediate bulk containers adapted to be used repeatedly and popularly referred to within the industry as "multi-trip big bags".

Intermediate bulk containers in the form of large bags usually having an inner liner are becoming increasingly commonly used for the storage and dispensing of bulk particulate solids. Those adapted for repeated use have a tubular spout on their underside which must be untied and released to permit discharge.

The inner liner serves many purposes. The outer bag can be used many times without risk of contamination by inserting a replacement liner each time the bag is used. The inner liner prevents egress of very fine powders through the weave or seams of the outer bag. The liner prevents ingress of water to the product during transport of the bag and gives some measure of protection to the product if the outer bag should become damaged.

A major disadvantage of using an internal liner is the problem that occurs during the discharge of material from the bag. The common practice of discharging a bag is simply to hang the bag by four loops, open the spout on the outer bag, and unfasten the goose-neck of the internal liner, thus allowing the product to discharge freely or through a discharging machine. As the bag discharges the level of material eventually drops to a point where there is insufficient pressure to hold the liner against the walls of the bag, with the result that the liner slips and blocks the discharge outlet, or alternatively the liner drops through the spout and runs the risk of becoming entangled with the handling equipment below.

Various attempts to overcome this disadvantage by tying the upper end of the liner to support means before discharge have not proved wholly satisfactory since the liner can still collapse and interfere to some extent with discharge, as it sometimes can even when connected to cord means extendable against resilient means to draw the liner upwardly from the outer bag as emptying proceeds.

OBJECTS AND SUMMARY OF THE INVENTION

It is an object of the invention to provide means for overcoming the the aforesaid problem.

According to the present invention there is provided equipment of the kind referred to including a rigging frame to which the upper end of the outer bag of an intermediate bulk carrier can be anchored, a rotatably mounted spool with which the upper end of a liner to the carrier can be engaged, and means for rotating the spool to wind the liner thereonto as emptying of the carrier is effected.

The spool may be rotated by means of a double-acting pneumatic cylinder operating on the spool through a ratchet and pawl mechanism.

A further check pawl to prevent reverse rotation of the spool may be provided.

Means may be provided to lift the pawls to free the spool when the pneumatic supply to said double-acting cylinder is removed.

The invention will be further apparent from the following description, with reference to the several figures of the accompanying drawings, which show, by way of example only, one form of equipment of the kind referred to embodying same.

Figure 1:
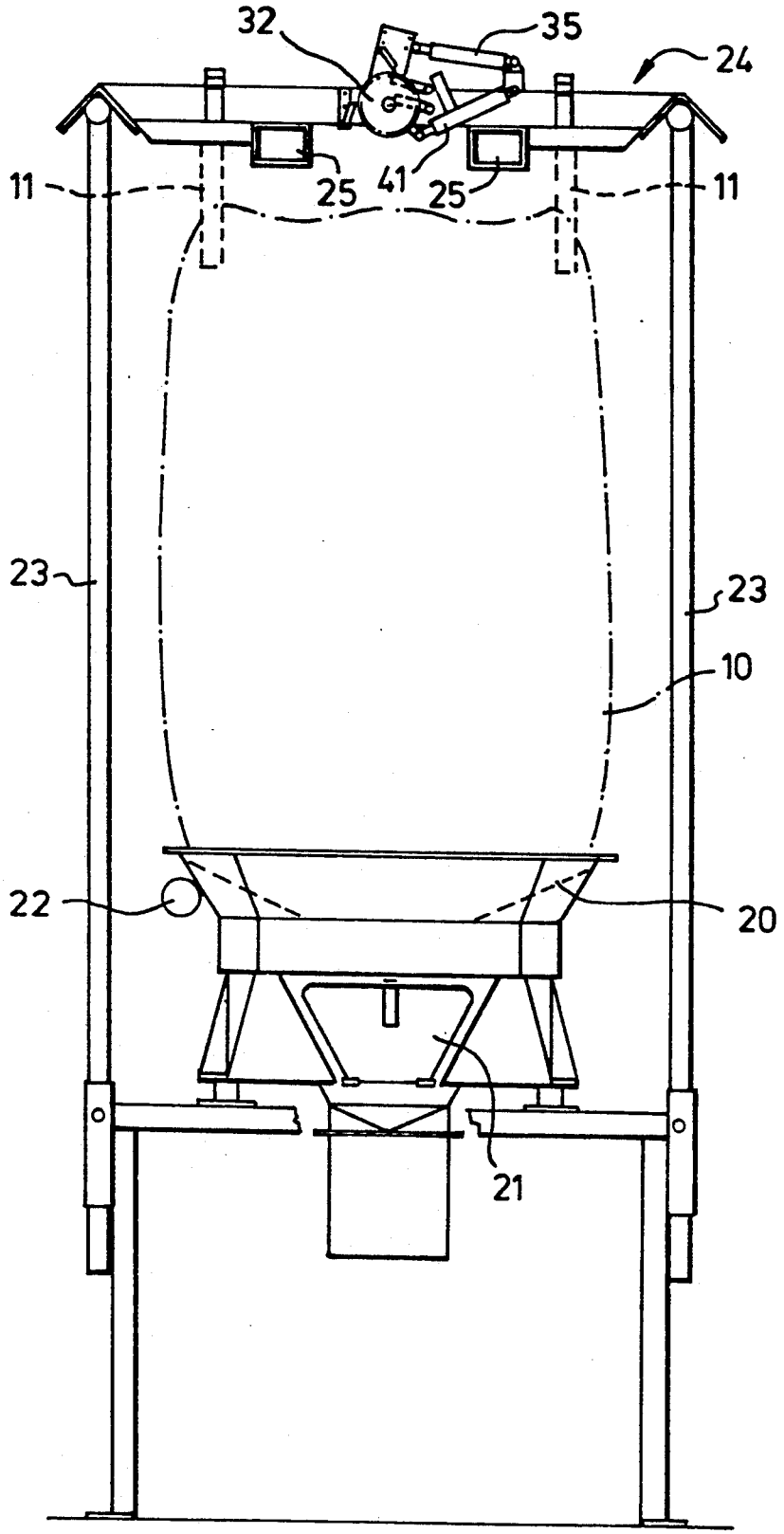
FIG. 1 shows a side elevation of the equipment.
Figure 2:
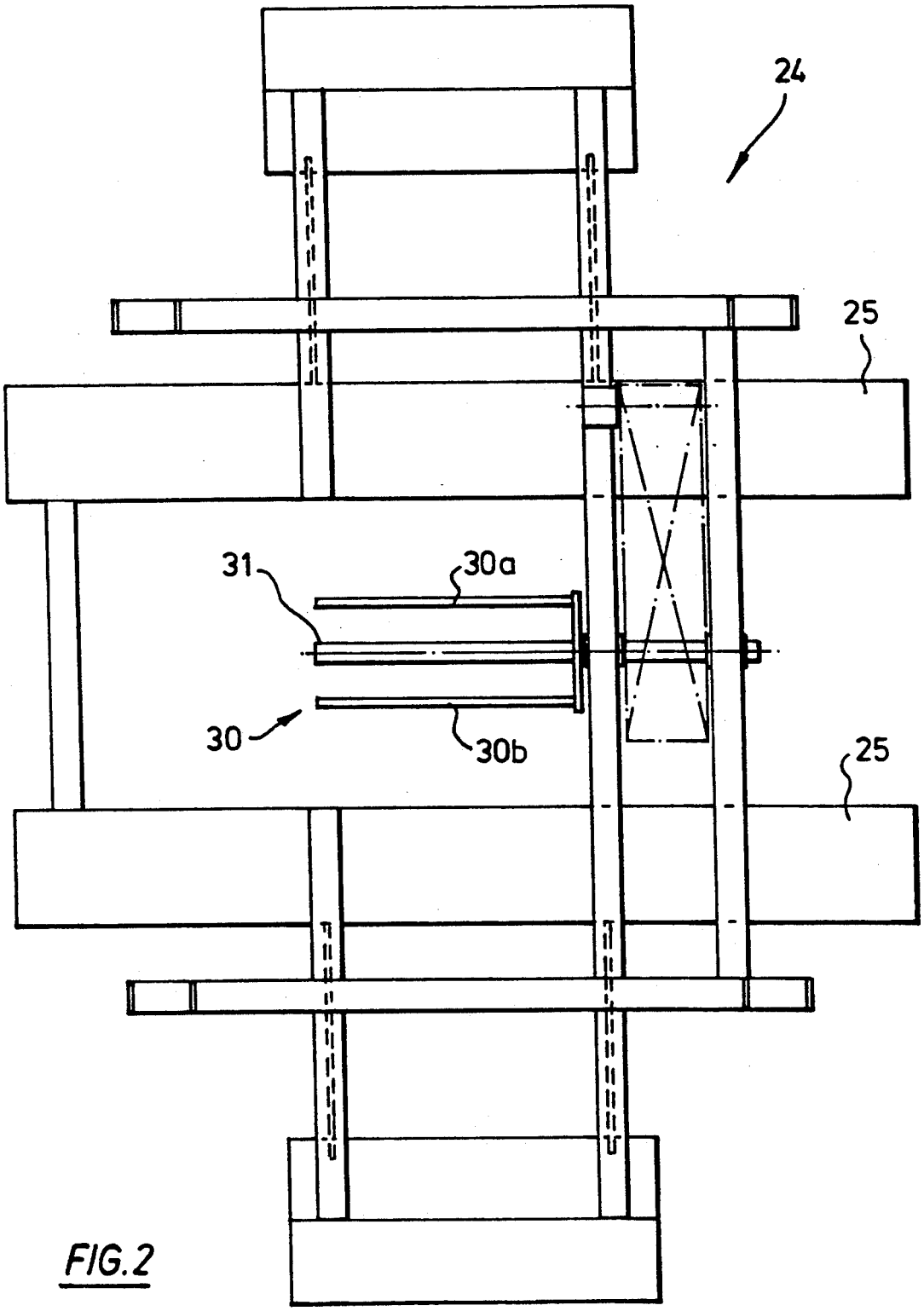
FIG. 2 shows a plan view of the rigging frame of the equipment of FIG. 1.
Figure 3:
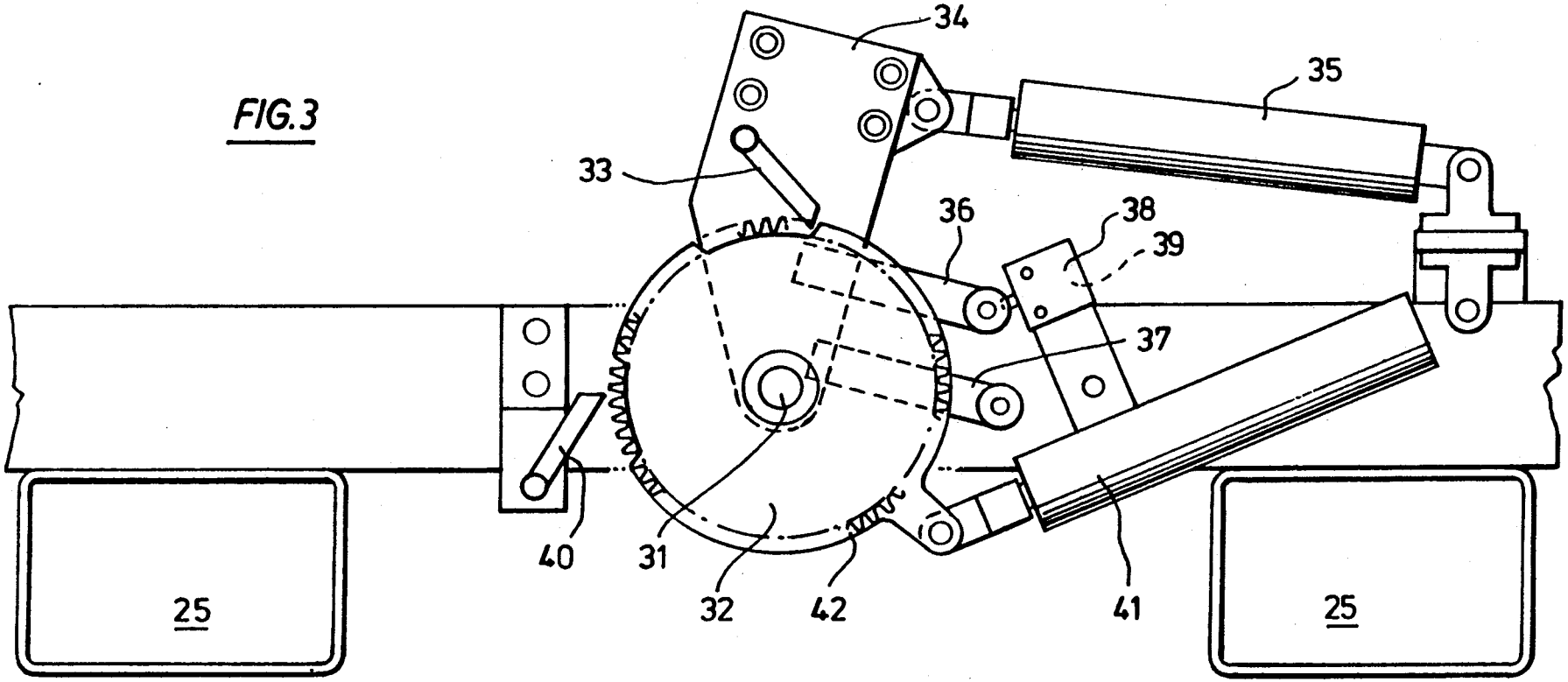
FIG. 3 shows a side elevation of the rigging frame of FIG. 2.
Figure 4:
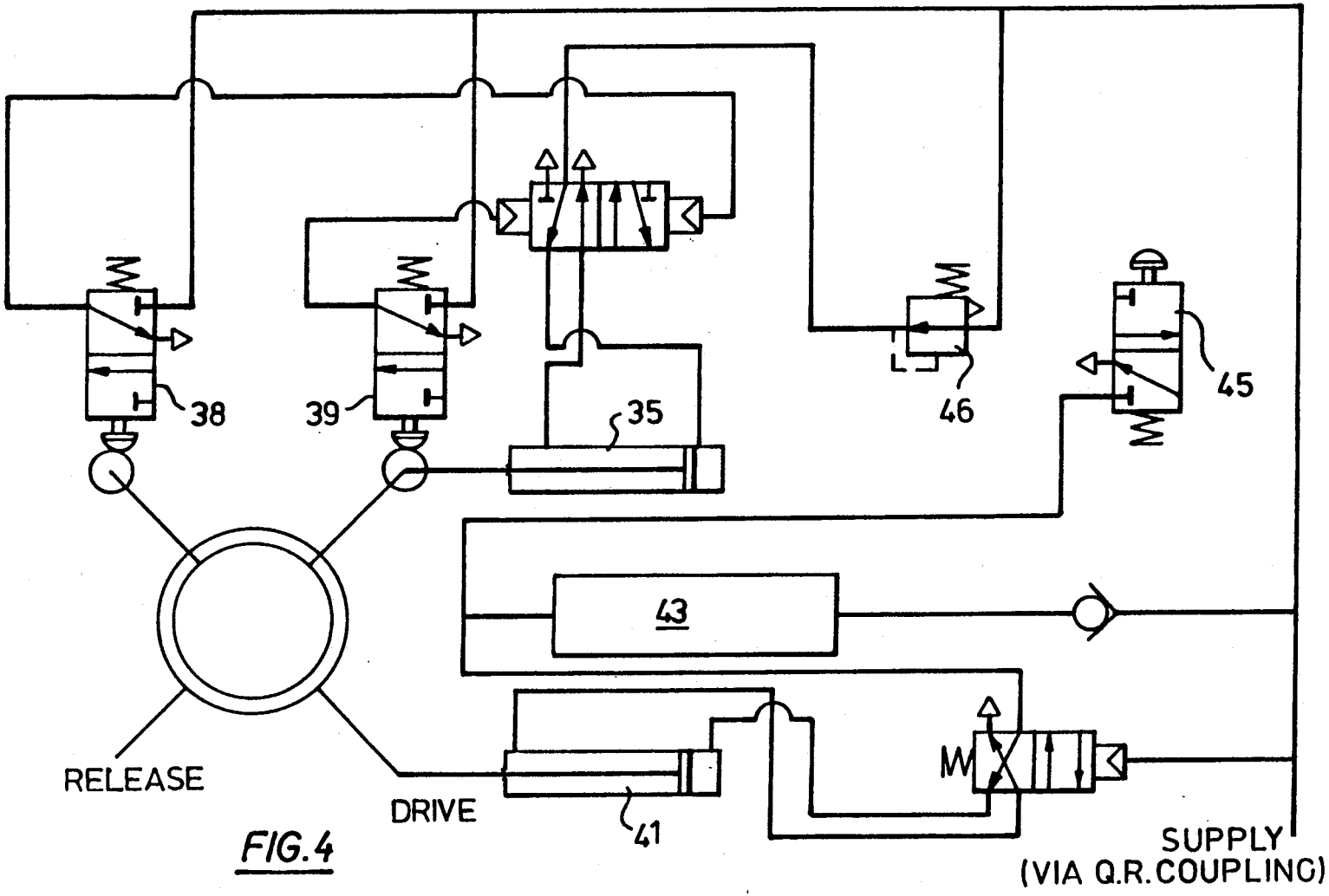
FIG. 4 shows a diagram of the pneumatic system of the equipment.

Referring now to the drawings, it will be seen that the discharge equipment comprises a shallow hopper 20 of square shape adapted to receive the lower end of the bag 10 and having a door 21 through which access may be had by an operator to untie and release the discharge spout of the bag 10 and also equipped with motor driven eccentric weight vibration means 22.

Posts 23 extend upwardly from the corners of the hopper 20 and form support means for a rigging frame 24.

When an intermediate bulk carrier is to be emptied, loops 11 on the upper end of the bag 10 are connected with the frame 24. This operation is known as 'rigging'. The frame and bag may be moved by fork-lift truck, whose forks can engage slots 25 on frame 24 to position the bag 10 on the hopper 20 and the frame 24 on the support means.

Secured to the rigging frame 24 is a spool 30 with which the upper end of the bag liner can be engaged. The spool 30 comprises spaced tines **30*a* and 30*b* and engagement of the liner can be effected by simply positioning the end of the liner between the tines. The spool is mounted on a shaft 31 for rotation about a horizontal axis and the shaft 31 carries a gear 32 which can be rotated in step-wise increments by a pawl 33 pivotally mounted on a plate 34 which is itself pivotally mounted on the shaft 31 and reciprocable by a double-acting pneumatic cylinder 35**.

The plate 34 carries cam members 36 and 37 to actuate pneumatic valves 38 and 39 in turn to reverse the piston of cylinder 35 at the end of each stroke thereof.

A second pawl 40 engages the gear 32 and serves to arrest any reverse rotation of the gear 32 and hence spool 30.

A second double-acting pneumatic cylinder 41 is provided and is connected with a lifter plate 42 rotatably mounted on the shaft 31. The cylinder 41 can be actuated to rotate plate 42 to lift each of the pawls 33 and 40 from the gear 32 to free the spool 30.

The pneumatic circuit includes a receiver 43 which provides pressure air to actuate the cylinder 41 whenever the main pneumatic supply through line 44 to the circuit is broken.

In use, and while the bag is being emptied, the cylinder 35 is operated to rotate the spool 30 to wind the liner onto the spool. It will be understood that the piston of the cylinder 35 cannot advance to rotate the spool 30 when the force which it is able to exert (determined by the pressure regulating valve 46) is less than the load on the liner. Once emptying has been completed the pneumatic supply can be broken to stop further winding and disengage the pawls 33 and 40 to allow the liner to be drawn downwardly through the bag for disposal. Alternatively, the pneumatic supply can be maintained to wind the entire length of the liner onto the spool 30. If the spool 30 is supported at one end only as shown, the wound-up liner can be slid therefrom for disposal.

When loading a new bag, and without the pneumatic supply, valve 45 may be operated to exhaust cylinder 41 enabling the lifter plate 42 to be manually repositioned.

It will be appreciated that it is not intended to limit the invention to the above example only, many variations, such as might readily occur to one skilled in the art, being possible, without departing from the scope thereof as defined by the appended claims.

Thus, for example, the drive unit for the spool may be separate from the spool itself and fixedly mounted on the support means. In this way only one such drive unit is required for each discharge unit, rather than for each rigging frame, and power connections to the drive unit can be permanent.

I claim:

1. A materials handling apparatus for emptying an intermediate bulk carrier bag which includes an outer bag and a linear comprising:

support means, a rigging frame mounted on said support means, first attachment means for attachment of said outer bag to said rigging frame, spool means rotatably mounted on said rigging frame, second attachment means for attachment of said liner to said spool means, and driving means mounted on said support means and connected to said spool means for the purpose of rotating said spool means, thereby winding said liner onto said spool means and emptying said intermediate bulk carrier bag.

2. A materials handling apparatus for emptying an intermediate bulk carrier bag which includes an outer bag and a linear comprising:

a rigging frame, first attachment means for attachment of said outer bag to said rigging frame, spool means rotatably mounted on said rigging frame, second attachment means for attachment of said liner to said spool means, driving means connected to said spool means for the purpose of rotating said spool means, thereby winding said liner onto said spool means and emptying said intermediate bulk carrier bag, and rotation control means connected to said spool means and disposed to prevent reverse rotation of said spool means.

3. A materials handling apparatus according to claim 2, in which said driving means comprises: double-acting pneumatic cylinder means mounted on said rigging frame, ratchet means mounted on said spool means, and first pawl means.

4. A materials handling apparatus according to claim 2, in which said rotation control means comprises second pawl means mounted on said rigging frame, with said second pawl means contacting said spool means.

5. A materials handling apparatus according to claim 3, in which said driving means further comprises: pneumatic supply means and connection means for connection of said pneumatic supply means to said double-acting pneumatic cylinder means.

6. A materials handling apparatus according to claim 5, further comprising release means to release said rotation control means and to free said spool means when said connection means are disconnected.

* * * * *